US006484138B2

(12) United States Patent
DeJaco

(10) Patent No.: US 6,484,138 B2
(45) **Date of Patent: *Nov. 19, 2002**

(54) METHOD AND APPARATUS FOR PERFORMING SPEECH FRAME ENCODING MODE SELECTION IN A VARIABLE RATE ENCODING SYSTEM

(75) Inventor: Andrew P. DeJaco, San Diego, CA (US)

(73) Assignee: Qualcomm, Incorporated, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/835,258

(22) Filed: Apr. 12, 2001

(65) Prior Publication Data

US 2001/0018650 A1 Aug. 30, 2001

Related U.S. Application Data

(63) Continuation of application No. 09/252,595, filed on Feb. 12, 1999, now Pat. No. 6,240,387, which is a continuation of application No. 08/815,354, filed on Mar. 11, 1997, now Pat. No. 5,911,128, which is a continuation of application No. 08/286,842, filed on Aug. 5, 1994, now abandoned.

(51) Int. Cl.[7] ..... G10L 19/00

(52) U.S. Cl. ..... 704/221; 704/214; 704/219; 704/229

(58) Field of Search ..... 704/221, 222, 704/223, 230, 214, 219, 229

(56) References Cited

U.S. PATENT DOCUMENTS

| | | | | |
|---|---|---|---|---|
| 3,633,107 A | 1/1972 | MacPherson | ..... | 325/305 |
| 4,012,595 A | 3/1977 | Ota | ..... | 179/15 |
| 4,076,958 A | 2/1978 | Fulghum | ..... | 179/1.5 |
| 4,214,125 A | 7/1980 | Mozer et al. | ..... | 179/1 |
| 4,360,708 A | 11/1982 | Taguchi et al. | ..... | 179/15.55 |
| 4,535,472 A | 8/1985 | Tomcik | ..... | 381/31 |
| 4,610,022 A | 9/1986 | Kitayama et al. | ..... | 381/36 |

(List continued on next page.)

OTHER PUBLICATIONS

A 4.8 KBPS Code Excited Linear Predictive Coder, Thomas E. Tremain et al., U.S. Department of Defense, R5 Fort Meade, Maryland, U.S.A. 20755–6000, pp. 491–496.

Phonetically–Based Vector Excitation Coding of Speech at 3.6 kbps. Speech Processing 1 S1, 1989 International Conference on Acoustics, Speech, and Signal Processing, IEEE, vol. 1., Feb. 1989, pp. 49–52.

Variable Rate Speech Coding for Asynchronous Transfer Mode, Hiroshi Nakada and Ken–Ichi Sato, IEEE Transactions on Communications. vol. 38. No. 3., Mar. 1990, pp. 277–284.

(List continued on next page.)

*Primary Examiner*—Marsha D. Banks-Harold
*Assistant Examiner*—Susan McFadden
(74) *Attorney, Agent, or Firm*—Philip Wadsworth; Kent D. Baker; Kyong H. Macek

(57) ABSTRACT

It is an objective of the present invention to provide an optimized method of selection of the encoding mode that provides rate efficient coding of the input speech. It is a second objective of the present invention to identify and provide a means for generating a set of parameters ideally suited for this operational mode selection. Third, it is an objective of the present invention to provide identification of two separate conditions that allow low rate coding with minimal sacrifice to quality. The two conditions are the coding of unvoiced speech and the coding of temporally masked speech. It is a fourth objective of the present invention to provide a method for dynamically adjusting the average output data rate of the speech coder with minimal impact on speech quality.

10 Claims, 2 Drawing Sheets

U.S. PATENT DOCUMENTS

| | | | | | |
|---|---|---|---|---|---|
| 4,672,669 | A | | 6/1987 | Desblache et al. | 381/46 |
| 4,672,670 | A | | 6/1987 | Wang et al. | 381/47 |
| 4,677,671 | A | | 6/1987 | Galand et al. | 381/31 |
| RE32,580 | E | | 1/1988 | Atal et al. | 381/40 |
| 4,771,465 | A | | 9/1988 | Bronson et al. | 381/36 |
| 4,797,925 | A | | 1/1989 | Lin | 381/36 |
| 4,797,929 | A | | 1/1989 | Gerson et al. | 381/43 |
| 4,817,157 | A | | 3/1989 | Gerson | 381/40 |
| 4,827,517 | A | | 5/1989 | Atal et al. | 381/41 |
| 4,843,612 | A | | 6/1989 | Brusch et al. | 375/1 |
| 4,850,022 | A | | 7/1989 | Honda et al. | 381/36 |
| 4,852,179 | A | | 7/1989 | Fette | 381/29 |
| 4,856,068 | A | | 8/1989 | Quatieri, Jr. et al. | 381/47 |
| 4,864,561 | A | | 9/1989 | Asbanfelter et al. | 370/81 |
| 4,868,867 | A | | 9/1989 | Davidson et al. | 381/36 |
| 4,885,790 | A | | 12/1989 | McAulay et al. | 381/36 |
| 4,890,327 | A | | 12/1989 | Bertrand et al. | 381/38 |
| 4,899,384 | A | | 2/1990 | Crouse et al. | 381/31 |
| 4,899,385 | A | | 2/1990 | Ketchum et al. | 381/36 |
| 4,903,301 | A | | 2/1990 | Kondo et al. | 381/30 |
| 4,905,288 | A | | 2/1990 | Gerson et al. | 381/43 |
| 4,933,957 | A | | 6/1990 | Bottau et al. | 375/27 |
| 4,965,789 | A | | 10/1990 | Bottau et al. | 370/79 |
| 4,991,214 | A | | 2/1991 | Freeman et al. | 381/38 |
| 5,023,910 | A | | 6/1991 | Thomson | 381/37 |
| 5,054,072 | A | | 10/1991 | Mcaulay et al. | 381/31 |
| 5,060,269 | A | | 10/1991 | Zinser | 381/38 |
| 5,077,798 | A | | 12/1991 | Ichikawa et al. | 381/36 |
| 5,093,863 | A | | 3/1992 | Galand et al. | 381/38 |
| 5,103,459 | A | | 4/1992 | Gilhousen et al. | 375/1 |
| 5,113,448 | A | | 5/1992 | Nomura et al. | 381/47 |
| 5,127,053 | A | | 6/1992 | Koch | |
| 5,140,638 | A | | 8/1992 | Moulsley et al. | 381/36 |
| 5,187,745 | A | | 2/1993 | Yip et al. | 381/36 |
| 5,222,189 | A | | 6/1993 | Fielder | 395/2 |
| 5,341,456 | A | | 8/1994 | DeJaco | |
| 5,414,796 | A | * | 5/1995 | Jacobs et al. | 704/221 |
| 5,596,676 | A | | 1/1997 | Swaminathan et al. | |
| 5,651,091 | A | | 7/1997 | Chen | |
| 5,680,508 | A | | 10/1997 | Liu | |
| 5,734,789 | A | | 3/1998 | Swaminathan et al. | |
| 5,742,734 | A | | 4/1998 | DeJaco et al. | |
| 5,774,496 | A | * | 6/1998 | Butler et al. | 375/225 |
| 5,778,338 | A | * | 7/1998 | Jacobs et al. | 704/223 |
| 5,911,128 | A | | 6/1999 | DeJaco | |
| 5,974,079 | A | | 10/1999 | Wang et al. | |
| 6,122,384 | A | * | 9/2000 | Mauro | 381/94.3 |
| 6,233,549 | B1 | * | 5/2001 | Mauro et al. | 704/207 |
| 6,240,387 | B1 | * | 5/2001 | DeJaco | 704/221 |

OTHER PUBLICATIONS

Stochastic Coding of Speech Signals at Very Low Bit Rates: The Importance of Speech Perception, Manfred R. Schroeder and Bishnu S. Atal, IEEE Speech Communication 4, pp. 155–162.

Predictive Coding of Speech at Low Bit Rates, Bishnu S. Atal, IEEE Transactions on Communications, vol. COM–30, No. 4, Apr. 1982, pp. 600–614.

Improving Performance of Multi–Pulse LPC Coders at Low Bit Rates, Sharad Singhai and Bishnu S. Atal, Acoustics Research Department AT&T Bell Laboratories, Murray Hill, NJ 07974, pp. 1.3.1–1.3.4.

Adaptive Predictive Coding of Speech Signals, B.S. Atal and M.R. Schroeder, Bell Syst. Tech. J., vol. 49, Oct. 1970, pp. 1973–1986.

Stochastic Coding of Speech Signals at Very Low Bit Rates, Bishnu S. Atal and Manfred R. Schroeder, IEEE, Sep. 1984.

Variable Bit Rate Adaptive Predictive Coder, Ioannis S. Debes et al., IEEE, 1992, pp. 511–517.

Variable Rate Speech Coding with Online Segmentation and Fast Algebraic Codes, R. Di Francesco, et al., IEEE, 1990, pp. 233–236.

Variable Rate Speech Coding: A Review, Acoustics Research Department AT&T Bell Laboratories Murray Hill, NJ 07974, IEEE, Sep. 1984.

Fast Methods for the CELP Speech Coding Algorithm, W. Bastiaan Kleijn, et al, Transactions on Acoustics, Speech, and Signal Processing, vol. 38, No. 8, Aug. 1990, pp. 1330–1341.

DSP Chips Can Produce Random Numbers Using Proven Algorithm, Paul Mennen, Tektronix Inc., EDN Jan. 21, 1991, pp. 141–146.

Code–Excited Linear Prediction (CELP): High–Quality Speech at Very Low Bit Rates, Bishnu S. Atal and Manfred R. Schroeder, IEEE, 1985, pp. 937–940.

* cited by examiner

METHOD AND APPARATUS FOR PERFORMING SPEECH FRAME ENCODING MODE SELECTION IN A VARIABLE RATE ENCODING SYSTEM

CROSS-REFERENCE TO RELATED APPLICATIONS

This is a Continuation of application Ser. No. 09/252,595, Feb. 12, 1999, now U.S. Pat. No. 6,240,387, which is a Continuation of application Ser. No. 08/815,354, now U.S. Pat. No. 5,911,128, filed on Mar. 11, 1997, which is a Continuation of application Ser. No. 08/286,842, filed Aug. 5, 1994, now abandoned; all assigned to the assignee of the present invention.

BACKGROUND

I. Field

The present invention relates to communications. More particularly, the present invention relates to a novel and improved method and apparatus for performing variable rate code excited linear predictive (CELP) coding.

II. Description of the Related Art

Transmission of voice by digital techniques has become widespread, particularly in long distance and digital radio telephone applications. This, in turn, has created interest in determining the least amount of information which can be sent over the channel which maintains the perceived quality of the reconstructed speech. If speech is transmitted by simply sampling and digitizing, a data rate on the order of 64 kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices which employ techniques to compress voiced speech by extracting parameters that relate to a model of human speech generation are typically called vocoders. Such devices are composed of an encoder, which analyzes the incoming speech to extract the relevant parameters, and a decoder, which resynthesizes the speech using the parameters which it receives over the transmission channel. In order to be accurate, the model must be constantly changing. Thus the speech is divided into blocks of time, or analysis frames, during which the parameters are calculated. The parameters are then updated for each new frame.

Of the various classes of speech coders the Code Excited Linear Predictive Coding (CELP), Stochastic Coding or Vector Excited Speech Coding are of one class. An example of a coding algorithm of this particular class is described in the paper "A 4.8 kbps Code Excited Linear Predictive Coder" by Thomas E. Tremain et al., *Proceedings of the Mobile Satellite Conference,* 1988.

The function of the vocoder is to compress the digitized speech signal into a low bit rate signal by removing all of the natural redundancies inherent in speech. Speech typically has short term redundancies due primarily to the filtering operation of the vocal tract, and long term redundancies due to the excitation of the vocal tract by the vocal cords. In a CELP coder, these operations are modeled by two filters, a short term formant filter and a long term pitch filter. Once these redundancies are removed, the resulting residual signal can be modeled as white Gaussian noise, which also must be encoded. The basis of this technique is to compute the parameters of a filter, called the LPC filter, which performs short-term prediction of the speech waveform using a model of the human vocal tract. In addition, long-term effects, related to the pitch of the speech, are modeled by computing the parameters of a pitch filter, which essentially models the human vocal chords. Finally, these filters must be excited, and this is done by determining which one of a number of random excitation waveforms in a codebook results in the closest approximation to the original speech when the waveform excites the two filters mentioned above. Thus the transmitted parameters relate to three items (1) the LPC filter, (2) the pitch filter and (3) the codebook excitation.

Although the use of vocoding techniques further the objective in attempting to reduce the amount of information sent over the channel while maintaining quality reconstructed speech, other techniques need be employed to achieve further reduction. One technique previously used to reduce the amount of information sent is voice activity gating. In this technique no information is transmitted during pauses in speech. Although this technique achieves the desired result, of data reduction, it suffers from several deficiencies.

In many cases, the quality of speech is reduced due to clipping of the initial parts of word. Another problem with gating the channel off during inactivity is that the system users perceive the lack of the background noise which normally accompanies speech and rate the quality of the channel as lower than a normal telephone call. A further problem with activity gating is that occasional sudden noises in the background may trigger the transmitter when no speech occurs, resulting in annoying bursts of noise at the receiver.

In an attempt to improve the quality of the synthesized speech in voice activity gating systems, synthesized comfort noise is added during the decoding process. Although some improvement in quality is achieved from adding comfort noise, it does not substantially improve the overall quality since the comfort noise does not model the actual background noise at the encoder.

A preferred technique to accomplish data compression, so as to result in a reduction of information that needs to be sent, is to perform variable rate vocoding. Since speech inherently contains periods of silence, i.e. pauses, the amount of data required to represent these periods can be reduced. Variable rate vocoding most effectively exploits this fact by reducing the data rate for these periods of silence. A reduction in the data rate, as opposed to a complete halt in data transmission, for periods of silence overcomes the problems associated with voice activity gating while facilitating a reduction in transmitted information.

Copending U.S. Pat. No. 5,414,796, issued May 9, 1995, entitled "Variable Rate Vocoder" and assigned to the assignee of the present invention and is incorporated by reference herein details a vocoding algorithm of the previously mentioned class of speech coders, Code Excited Linear Predictive Coding (CELP), Stochastic Coding or Vector Excited Speech Coding. The CELP technique by, itself does provide a significant reduction in the amount of data necessary to represent speech in a manner that upon resynthesis results in high quality speech. As mentioned previously the vocoder parameters are updated for each frame. The vocoder detailed in the above-mentioned patent provides a variable output data rate by changing the frequency and precision of the model parameters.

The vocoding algorithm of the above-mentioned patent differs most markedly from the prior CELP techniques by producing a variable output data rate based on speech activity. The structure is defined so that the parameters are updated less often, or with less precision, during pauses in speech. This technique allows for an even greater decrease in the amount of information to be transmitted. The phenomenon which is exploited to reduce the data rate is the voice activity factor, which is the average percentage of time a given speaker is actually talking during a conversation. For typical two-way telephone conversations, the average data rate is reduced by a factor of 2 or more. During pauses in speech, only background noise is being coded by the vocoder. At these times, some of the parameters relating to the human vocal tract model need not be transmitted.

As mentioned previously a prior approach to limiting the amount of information transmitted during silence is called voice activity gating, a technique in which no information is transmitted during moments of silence. On the receiving side the period may be filled in with synthesized "comfort noise". In contrast, a variable rate vocoder is continuously transmitting data which, in the exemplary embodiment of the above-mentioned patent, is at rates which range between approximately 8 kbps and 1 kbps. A vocoder which provides a continuous transmission of data eliminates the need for synthesized "comfort noise", with the coding of the background noise providing a more natural quality to the synthesized speech. The invention of the aforementioned patent therefore provides a significant improvement in synthesized speech quality over that of voice activity gating by allowing a smooth transition between speech and background.

The vocoding algorithm of the above mentioned patent enables short pauses in speech to be detected, a decrease in the effective voice activity factor is realized. Rate decisions can be made on a frame by frame basis with no hangover, so the data rate may be lowered for pauses in speech as short as the frame duration, typically 20 msec. Therefore pauses such as those between syllables may be captured. This technique decreases the voice activity factor beyond what has traditionally been considered, as not only long duration pauses between phrases, but also shorter pauses can be encoded at lower rates.

Since rate decisions are made on a frame basis, there is no clipping of the initial part of the word, such as in a voice activity gating system. Clipping of this nature occurs in voice activity gating system due to a delay between detection of the speech and a restart in transmission of data. Use of a rate decision based upon each frame results in speech where all transitions have a natural sound.

With the vocoder always transmitting, the speaker's ambient background noise will continually be heard on the receiving end thereby yielding a more natural sound during speech pauses. The present invention thus provides a smooth transition to background noise. What the listener hears in the background during speech will not suddenly change to a synthesized comfort noise during pauses as in a voice activity gating system.

Since background noise is continually vocoded for transmission, interesting events in the background can be sent with full clarity. In certain cases the interesting background noise may even be coded at the highest rate. Maximum rate coding may occur, for example, when there is someone talking loudly in the background, or if an ambulance drives by a user standing on a street corner. Constant or slowly varying background noise will, however, be encoded at low rates.

The use of variable rate vocoding has the promise of increasing the capacity of a Code Division Multiple Access (CDMA) based digital cellular telephone system by more than a factor of two. CDMA and variable rate vocoding are uniquely matched, since, with CDMA, the interference between channels drops automatically as the rate of data transmission over any channel decreases. In contrast, consider systems in which transmission slots are assigned, such as TDMA or FDMA. In order for such a system to take advantage of any drop in the rate of data transmission, external intervention is required to coordinate the reassignment of unused slots to other users. The inherent delay in such a scheme implies that the channel may be reassigned only during long speech pauses. Therefore, full advantage cannot be taken of the voice activity factor. However, with external coordination, variable rate vocoding is useful in systems other than CDMA because of the other mentioned reasons.

In a CDMA system speech quality can be slightly degraded at times when extra system capacity is desired. Abstractly speaking, the vocoder can be thought of as multiple vocoders all operating at different rates with different resultant speech qualities. Therefore the speech qualities can be mixed in order to further reduce the average rate of data transmission. Initial experiments show that by mixing full and half rate vocoded speech, e.g. the maximum allowable data rate is varied on a frame by frame basis between 8 kbps and 4 kbps, the resulting speech has a quality which is better than half rate variable, 4 kbps maximum, but not as good as full rate variable, 8 kbps maximum.

It is well known that in most telephone conversations, only one person talks at a time. As an additional function for full-duplex telephone links a rate interlock may be provided. If one direction of the link is transmitting at the highest transmission rate, then the other direction of the link is forced to transmit at the lowest rate. An interlock between the two directions of the link can guarantee no greater than 50% average utilization of each direction of the link. However, when the channel is gated off, such as the case for a rate interlock in activity gating, there is no way for a listener to interrupt the talker to take over the talker role in the conversation. The vocoding method of the above mentioned patent readily provides the capability of an adaptive rate interlock by control signals which set the vocoding rate.

In the above-mentioned patent the vocoder operates at either full rate when speech is present or eighth rate when speech is not present. The operation of the vocoding algorithm at half and quarter rates is reserved for special conditions of impacted capacity or when other data is to be transmitted in parallel with speech data.

U.S. Pat. No. 5,857,147, issued Jan. 5, 1999, entitled "Method and Apparatus for Determining the Transmission Data Rate in a Multi-User Communication System" and assigned to the assignee of the present invention and is incorporated by reference herein details a method by which a communication system in accordance with system capacity measurements limits the average data rate of frames encoded by a variable rate vocoder. The system reduces the average data rate by forcing predetermined frames in a string of full rate frames to be coded at a lower rate, i.e. half rate. The problem with reducing the encoding rate for active speech frames in this fashion is that the limiting does not correspond to any characteristics of the input speech and so is not optimized for speech compression quality.

Also, in U.S. Pat. No. 5,341,456, issued Aug. 23, 1994, entitled "Improved Method for Determining Speech Encoding Rate in a Variable Rate Vocoder", and assigned to the assignee of the present invention and is incorporated by reference herein, a method for distinguishing unvoiced speech from voiced speech is disclosed. The method disclosed examines the energy of the speech and the spectral tilt of the speech and uses the spectral tilt to distinguish unvoiced speech from background noise.

Variable rate vocoders that vary the encoding rate based entirely on the voice activity of the input speech fail to realize the compression efficiency of a variable rate coder that varies the encoding rate based on the complexity or information content that is dynamically varying during active speech. By matching the encoding rates to the complexity of the input waveform more efficient speech coders can be built. Furthermore, systems that seek to dynamically adjust the output data rate of the variable rate vocoders should vary the data rates in accordance with characteristics of the input speech to attain an optimal voice quality for a desired average data rate.

SUMMARY

The present invention is a novel and improved method and apparatus for encoding active speech frames at a reduced data rate by encoding speech frames at rates between a predetermined maximum rate and a predetermined minimum rate. The present invention designates a set of active speech operation modes. In the exemplary embodiment of the present invention, there are four active speech operation modes, full rate speech, half rate speech, quarter rate unvoiced speech and quarter rate voiced speech.

It is an objective of the present invention to provide an optimized method for selecting an encoding mode that provides rate efficient coding of the input speech. It is a second objective of the present invention to identify a set of parameters ideally suited for this operational mode selection and to provide a means for generating this set of parameters. Third, it is an objective of the present invention to provide identification of two separate conditions that allow low rate coding with minimal sacrifice to quality. The two conditions are the presence of unvoiced speech and the presence of temporally masked speech. It is a fourth objective of the present invention to provide a method for dynamically adjusting the average output data rate of the speech coder with minimal impact on speech quality.

The present invention provides a set of rate decision criteria referred to as mode measures. A first mode measure is the target matching signal to noise ratio (TMSNR) from the previous encoding frame, which provides information on how well the synthesized speech matches the input speech or, in other words, how well the encoding model is performing. A second mode measure is the normalized autocorrelation function (NACF), which measures periodicity in the speech frame. A third mode measure is the zero crossings (ZC) parameter which is a computationally inexpensive method for measuring high frequency content in an input speech frame. A fourth measure is the prediction gain differential (PGD) which determines if the LPC model is maintaining its prediction efficiency. The fifth measure is the energy differential (ED) which compares the energy in the current frame to an average frame energy.

The exemplary embodiment of the vocoding algorithm of the present invention uses the five mode measures enumerated above to select an encoding mode for an active speech frame. The rate determination logic of the present invention compares the NACF against a first threshold value and the ZC against a second threshold value to determine if the speech should be coded as unvoiced quarter rate speech.

If it is determined that the active speech frame contains voiced speech, then the vocoder examines the parameter ED to determine if the speech frame should be coded as quarter rate voiced speech. If it is determined that the speech is not to be coded at quarter rate, then the vocoder tests if the speech can be coded at half rate. The vocoder tests the values of TMSNR, PGD and NACF to determine if the speech frame can be coded at half rate. If it is determined that the active speech frame cannot be coded at quarter or half rates, then the frame is coded at full rate.

It is further an objective to provide a method for dynamically changing threshold values in order to accommodate rate requirements. By varying one or more of the mode selection thresholds it is possible to increase or decrease the average data transmission rate. So by dynamically adjusting the threshold values an output rate can be adjusted.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION

In the exemplary embodiment, speech frames of 160 speech samples are encoded. In the exemplary embodiment of the present invention, there are four data rates full rate, half rate, quarter rate and eighth rate. Full rate corresponds to an output data rate of 14.4 kbps. Half rate corresponds to an output data rate of 7.2 kbps. Quarter rate corresponds to an output data rate of 3.6 kbps. Eighth rate corresponds to an output data rate of 1.8 kbps, and is reserved for transmission during periods of silence.

It should be noted that the present invention relates only to the coding of active speech frames, frames that are detected to have speech present in them. The method for detecting the presence of speech is detailed in the aforementioned U.S. Pat. Nos. 5,414,796 and 5,341,456.

Figure 1:
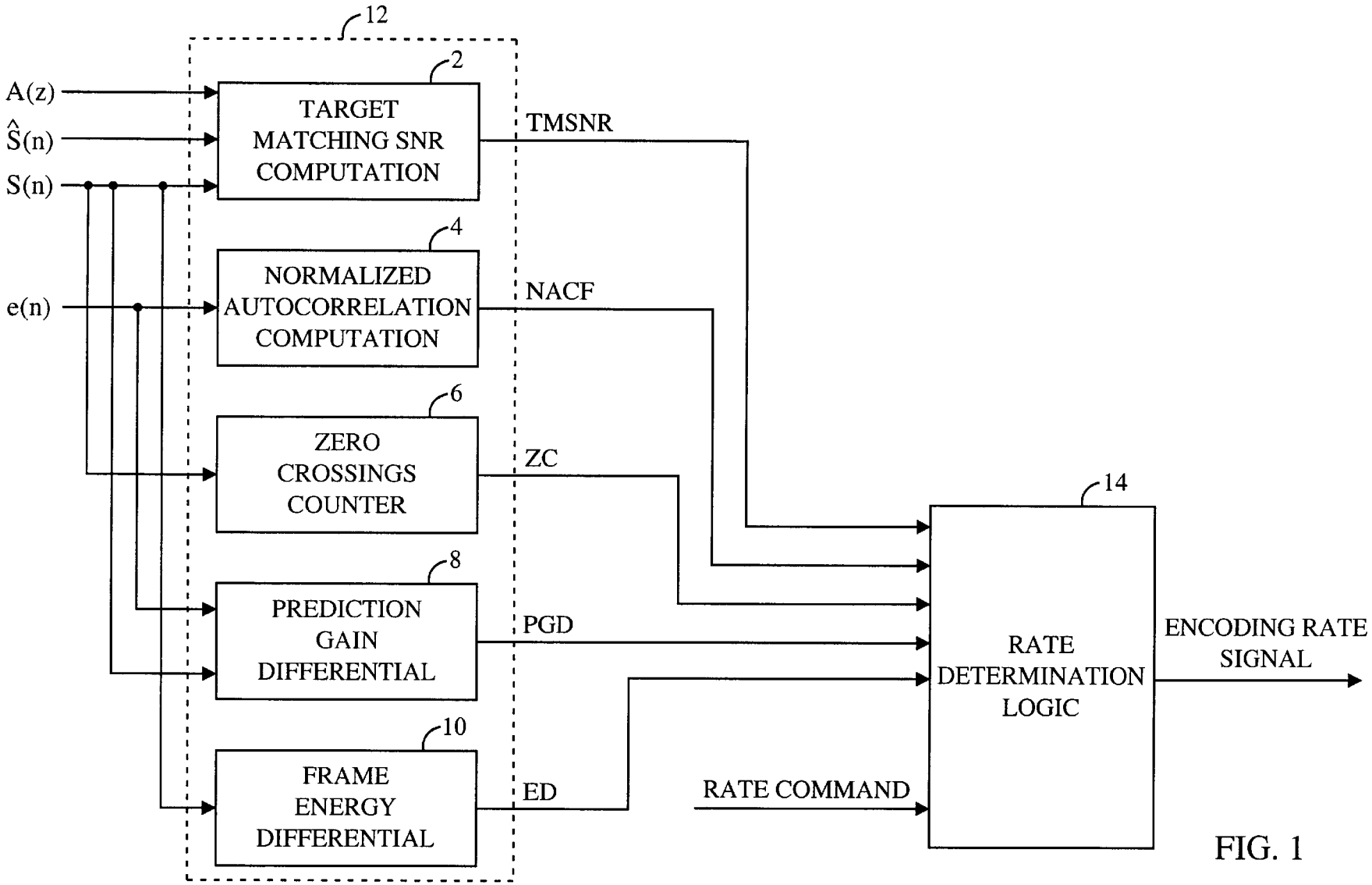
FIG. 1 is a block diagram of the encoding rate determination apparatus of the present invention.

Referring to FIG. 1, mode measurement element 12 determines values of five parameters used by rate determination logic 14 to select an encoding rate for the active speech frame. In the exemplary embodiment, mode measurement element 12 determines five parameters which it provides to rate determination logic 14. Based on the parameters provided by mode measurement element 12, rate determination logic 14 selects an encoding rate of full rate, half rate or quarter rate.

Rate determination logic 14 selects one of four encoding modes in accordance with the five generated parameters. The four modes of encoding include full rate mode, half rate mode, quarter rate unvoiced mode and quarter rate voiced mode. Quarter rate voiced mode and quarter rate unvoiced mode provide data at the same rate but by means of different encoding strategies. Half rate mode is used to code stationary, periodic, well modeled speech. Both quarter rate voiced, quarter rate unvoiced, and half rate modes take advantage of portions of speech that do not require high precision in the coding of the frame.

Quarter rate unvoiced mode is used in the coding of unvoiced speech. Quarter rate voiced mode is used in the coding of temporally masked speech frames. Most CELP speech coders take advantage of simultaneous masking in which speech energy at a given frequency masks out noise energy at the same frequency and time making the noise inaudible. Variable rate speech coders can take advantage of temporal masking in which low energy active speech frames are masked by preceding high energy speech frames of similar frequency content. Because the human ear is integrating energy over time in various frequency bands, low energy frames are time averaged with the high energy frames thus lowering the coding requirements for the low energy frames. Taking advantage of this temporal masking auditory phenomena allows the variable rate speech coder to reduce the encoding rate during this mode of speech. This psychoacoustic phenomenon is detailed in *Psychoacoustics* by E. Zwicker and H. Fastl, pp. 56–101.

Mode measurement element 12 receives four input signals with which it generates the five mode parameters. The first signal that mode measurement element 12 receives is S(n) which is the uncoded input speech samples. In the exemplary embodiment, the speech samples are provided in frames containing 160 samples of speech. The speech frames that are provided to mode measurement element 12 all contain active speech. During periods of silence, the active speech rate determination system of the present invention is inactive.

The second signal that mode measurement element 12 receives is the synthesized speech signal, $\hat{S}(n)$, which is the decoded speech from the encoder's decoder of the variable rate CELP coder. The encoder's decoder decodes a frame of encoded speech for the purpose of updating filter parameters and memories in analysis by synthesis based CELP coder. The design of such decoders are well known in the art and are detailed in the above mentioned U.S. Pat. No. 5,414,796.

The third signal that mode measurement element 12 receives is the formant residual signal e(n). The formant residual signal is the speech signal S(n) filtered by the linear prediction coding (LPC) filter of the CELP coder. The design of LPC filters and the filtering of signals by such filters is well known in the art and detailed in the above mentioned U.S. Pat. No. 5,414,796. The fourth input to mode measurement element 12 is A(z) which are the filter tap values of the perceptual weighting filter of the associated CELP coder. The generation of the tap values, and filtering operation of a perceptual weighting filter are well known in the art and are detailed in U.S. Pat. No. 5,414,796.

Target matching signal to noise ratio (SNR) computation element 2 receives the synthesized speech signal, $\hat{S}(n)$, the speech samples S(n), and a set of perceptual weighting filter tap values A(z). Target matching SNR computation element 2 provides a parameter, denoted TMSNR, which indicates how well the speech model is tracking the input speech. Target matching SNR computation element 2 generates TMSNR in accordance with equation 1 below:

$$\mathrm{TMSNR} = 10 \cdot \log\left[\frac{\sum_{n=0}^{159} \hat{S}_W^2(n)}{\sum_{n=0}^{159} \left(S_W(n) - \hat{S}_W(n)\right)^2}\right], \tag{1}$$

where the subscript w denotes that signal has been filtered by a perceptual weighting filter.

Note that this measure is computed for the previous frame of speech, while the NACF, PGD, ED, ZC are computed on the current frame of speech. TMSNR is computed on the previous frame of speech since it is a function of the selected encoding rate and thus for computational complexity reasons it is computed on the previous frame from the frame being encoded.

The design and implementation of perceptual weighting filters is well known in the art and is detailed in that aforementioned U.S. Pat. No. 5,414,796. It should be noted that the perceptual weighting is preferred to weight the perceptually significant features of the speech frame. However, it is envisioned that the measurement could be made without perceptually weighting the signals.

Normalized autocorrelation computation element 4 receives the formant residual signal, e(n). The function of normalized autocorrelation computation element 4 is to provide an indication of the periodicity of samples in the speech frame. Normalized autocorrelation element 4 generates a parameter, denoted NACF in accordance with equation 2 below:

$$\mathrm{NACF} = \max_{T \in [20,120]} \frac{\sum_{n=0}^{159} e(n) \cdot e(n-T)}{\sum_{n=0}^{159} e^2(n)}. \tag{2}$$

It should be noted that the generation of this parameter requires memory of the formant residual signal from the encoding of the previous frame. This allows testing not only of the periodicity of the current frame, but also tests the periodicity of the current frame with the previous frame.

The reason that in the preferred embodiment the formant residual signal, e(n), is used instead of the speech samples, S(n), which could be used, in generating NACF is to eliminate the interaction of the formants of the speech signal. Passing the speech signal though the formant filter serves to flatten the speech envelope and thus whitens the resulting signal. It should be noted that the values of delay T in the exemplary embodiment correspond to pitch frequencies between 66 Hz and 400 Hz for a sampling frequency of 8000 samples per second. The pitch frequency for a given delay value T is calculated by equation 3 below:

$$f_{pitch} = \frac{f_s}{T}, \tag{3}$$

where $f_S$ is the sampling frequency.

It should be noted that the frequency range can be extended or reduced simply by selecting a different set of delay values. It should also be noted that the present invention is equally applicable to any sampling frequencies. Zero crossings counter 6 receives the speech samples S(n) and counts the number of times the speech samples change sign. This is a computationally inexpensive method of detecting high frequency components in the speech signal. This counter can be implemented in software by a loop of the form:

$$cnt=0 \tag{4}$$

$$\text{for } n=0,158 \tag{5}$$

$$\text{if } (S(n) \cdot S(n+1) < 0) cnt{+}{+} \tag{6}$$

The loop of equations 4–6 multiplies consecutive speech samples and tests if the product is less than zero indicating that the sign between the two consecutive samples differs. This assumes that there is no DC component to the speech signal. It well known in the art how to remove DC components from signals.

Prediction gain differential element 8 receives the speech signal S(n) and the formant residual signal e(n). Prediction gain differential element 8 generates a parameter denoted PGD, which determines if the LPC model is maintaining its prediction efficiency. Prediction gain differential element 8 generates the prediction gain, $P_g$, in accordance with equation 7 below:

$$P_g = \frac{\sum_{n=0}^{159} S^2(n)}{\sum_{n=0}^{159} e^2(n)} \tag{7}$$

The prediction gain of the present frame is then compared against the prediction gain of the previous frame in generating the output parameter PGD by equation 8 below:

$$\text{PGD} = 10 \cdot \log\left(\frac{P_g(i)}{P_g(i-1)}\right), \tag{8}$$

where i denotes the frame number.

In a preferred embodiment, prediction gain differential element 8 does not generate the prediction gain values $P_g$. In the generation of the LPC coefficients a byproduct of the Durbin's recursion is the prediction gain $P_g$ so no repetition of the computation is necessary.

Frame energy differential element 10 receives the speech samples S(n) of the present frame and computes the energy of the speech signal in the present frame in accordance with equation 9 below:

$$E_i = \sum_{n=0}^{159} S^2(n) \tag{9}$$

The energy of the present frame is compared to an average energy of previous frames $E_{ave}$. In the exemplary embodiment, the average energy, $E_{ave}$, is generated by a leaky integrator of the form:

$$E_{ave} = \square \cdot E_{ave} + (1 - \square \cdot E_i, \text{ where } 0 < \square\square = \square\square \tag{10}$$

The factor, □, determines the range of frames that are relevant in the computation. In the exemplary embodiment, the □□ is set to 0.8825 which provides a time constant of 8 frames. Frame energy differential element 10 then generates the parameter ED in accordance with equation 11 below:

$$\text{ED} = 10 \cdot \log \frac{E_i}{E_{ave}}. \tag{11}$$

Figure 2:
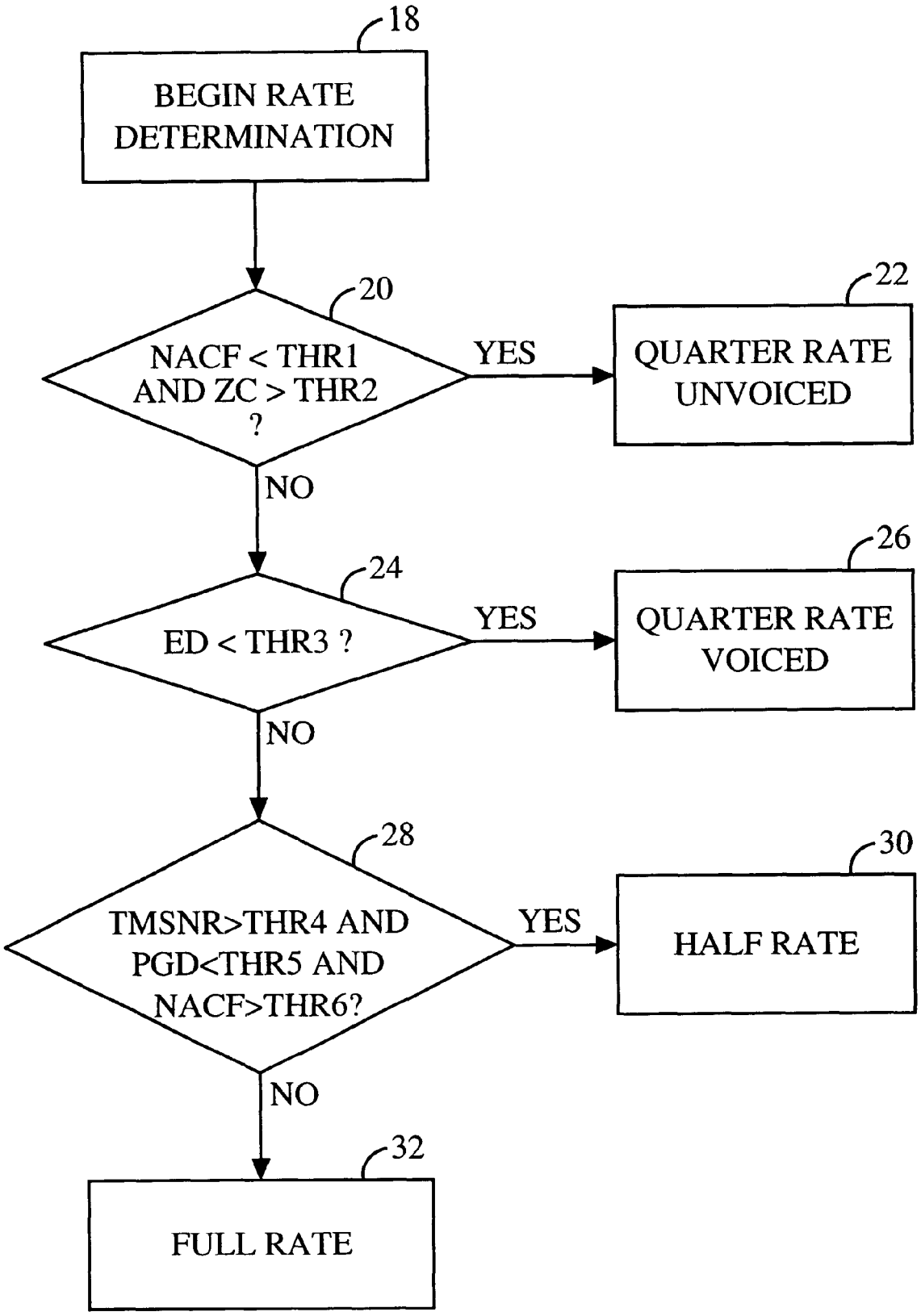
FIG. 2 is a flowchart illustrating the encoding rate selection process of the rate determination logic.

The five parameters, TMSNR, NACF, ZC, PGD, and ED are provided to rate determination logic 14. Rate determination logic 14 selects an encoding rate for the next frame of samples in accordance with the parameters and a predetermined set of selection rules. Referring now to FIG. 2, a flow diagram illustrating the rate selection process of rate determination logic element 14 is shown.

The rate determination process begins in block 18. In block 20, the output of normalized autocorrelation element 4, NACF, is compared against a predetermined threshold value, THR1 and the output of zero crossings counter is compared against a second predetermined threshold, THR2. If NACF is less than THR1 and ZC is greater than THR2, then the flow proceeds to block 22, which encodes the speech as quarter rate unvoiced. NACF being less than a predetermined threshold would indicate a lack of periodicity in the speech and ZC being greater than a predetermined threshold would indicate high frequency component in the speech. The combination of these two conditions indicates that the frame contains unvoiced speech. In the exemplary embodiment THR1 is 0.35 and THR2 is 50 zero crossing. If NACF is not less than THR1 or ZC is not greater than THR2, then the flow proceeds to block 24.

In block 24, the output of frame energy differential element 10, ED, is compared against a third threshold value, THR3. If ED is less than THR3, then the current speech frame will be encoded as quarter rate voiced speech in block 26. If the energy difference between the current frame is lower than the average by a more than a threshold amount, then a condition of temporally masked speech is indicated. In the exemplary embodiment, THR3 is −14 dB. If ED does not exceed THR3 then the flow proceeds to block 28.

In block 28, the output of target matching SNR computation element 2, TMSNR, is compared to a fourth threshold value, THR4; the output of prediction gain differential element 8, PGD, is compared against a fifth threshold value, THR5; and the output of normalized autocorrelation computation element 4, NACF, is compared against a sixth threshold value THR6. If TMSNR exceeds THR4; PGD is less than THR5; and NACF exceeds THR6, then the flow proceeds to block 30 and the speech is coded at half rate. TMSNR exceeding its threshold will indicate that the model and the speech being modeled were matching well in the previous frame. The parameter PGD less than its predetermined threshold is indicative that the LPC model is maintaining its prediction efficiency. The parameter NACF exceeding its predetermined threshold indicates that the frame contains periodic speech that is periodic with the previous frame of speech.

In the exemplary embodiment, THR4 is initially set to 10 dB, THR5 is set to −5 dB, and THR6 is set to 0.4. In block 28, if TMSNR does not exceed THR4, or PGD does not exceed THR5, or NACF does not exceed THR6, then the flow proceeds to block 32 and the current speech frame will be encoded at full rate.

By dynamically adjusting the threshold values an arbitrary overall data rate can be achieved. The overall active speech average data rate, R, can be defined for an analysis window W active speech frames as:

$$R = \frac{R_f \cdot \#R_f \text{ frames} + R_h \cdot \#R_h \text{ frames} + R_q \cdot \#Rq \text{ frames}}{W}, \tag{12}$$

where $R_f$ is the data rate for frames encoded at full rate, $R_h$ is the data rate for frames encoded at half rate, $R_q$ is the data rate for frames encoded at quarter rate, and $W = \#R_f \text{ frames} + \#R_h \text{ frames} + \#R_q \text{ frames}$.

By multiplying each of the encoding rates by the number of frames encoded at that rate and then dividing by the total number of frames in the sample an average data rate for the sample of active speech may be computed. It is important to have a frame sample size, W, large enough to prevent a long duration of unvoiced speech, such as drawn out "s" sounds from distorting the average rate statistic. In the exemplary embodiment, the frame sample size, W, for the calculation of the average rate is 400 frames.

The average data rate may be decreased by increasing the number of frames encoded at full rate to be encoded at half rate and conversely the average data rate may be increased by increasing the number of frames encoded at half rate to be encoded at full rate. In a preferred embodiment the threshold that is adjusted to effect this change is THR4. In the exemplary embodiment a histogram of the values of TMSNR are stored. In the exemplary embodiment, the stored TMSNR values are quantized into values an integral number of decibels from the current value of THR4. By maintaining athistogram of this sort it can easily be estimated how many frames would have changed in the previous analysis block from being encoded at full rate to being encoded at half rate were the THR4 to be decreased by an integral number of decibels. Conversely, an estimate of how many frames encoded at half rate would be encoded at full rate were the threshold to be increased by an integral number of decibels.

The equation for determining the number of frames that should change from ½ rate frames to full rate frames is determined by the equation:

$$\Delta = \frac{[\text{target rate} - \text{average rate}] \cdot W}{R_f - R_h}, \tag{13}$$

where

□ is the number of frames encoded at half rate that should be encoded at full rate in order to attain the target rate, and W=#$R_f$ frames+#$R_h$ frames+#$R_q$ frames.

$TMSNR_{NEW}$=$TMSNR_{OLD}$+(the number of dB from $TMSNR_{OLD}$ to achieve □ frame differences defined in equation 13 above)

Note that the initial value of TMSNR is a function of the target rate desired. In an exemplary embodiment of a target rate of 8.7 Kbps, in a system with $R_f$=14.4 kbps, $R_f$=7.2 kbps, $R_q$=3.6 kbps, the initial value of TMSNR is 10 dB.

It should be noted that quantizing the TMSNR values to integral numbers for the distance from the threshold THR4 can easily be made finer such as half or quarter decibels or can be made coarser such as one and a half or two decibels.

It is envisioned that the target rate may either be stored in a memory element of rate determination logic element 14, in which case the target rate would be a static value in accordance with which the THR4 value would be dynamically determined. In addition, to this initial target rate, it is envisioned that the communication system may transmit a rate command signal to the encoding rate selection apparatus based upon current capacity conditions of the system.

The rate command signal could either specify the target rate or could simply request an increase or decrease in the average rate. If the system were to specify the target rate, that rate would be used in determining the value of THR4 in accordance with equations 12 and 13. If the system specified only that the user should transmit at a higher or lower transmission rate, then rate determination logic element 14 may respond by changing the THR4 value by a predetermined increment or may compute an incremental change in accordance with a predetermined incremental increase or decrease in rate.

Blocks 22 and 26 indicate a difference in the method of encoding speech based upon whether the speech samples represent voiced or unvoiced speech. The unvoiced speech is speech in the form of fricatives and consonant sounds such as "f", "s", "sh", "t" and "z". Quarter rate voiced speech is temporally masked speech where a low volume speech frame follow a relatively high volume speech frame of similar frequency content. The human ear cannot hear the fine points of the speech in the a low volume frame that follows a high volume frames so bits can be saved by encoding this speech at quarter rate.

In the exemplary embodiment of encoding unvoiced quarter rate speech, a speech frame is divided into four subframes. All that is transmitted for each of the four subframes is a gain value G and the LPC filter coefficients A(z). In the exemplary embodiment, five bits are transmitted to represent the gain in each of each subframe. At a decoder, for each subframe, a codebook index is randomly selected. The randomly selected codebook vector is multiplied by the transmitted gain value and passed through the LPC filter, A(z), to generate the synthesized unvoiced speech.

In the encoding of voiced quarter rate speech, a speech frame is divided into two subframes and the CELP coder determines a codebook index and gain for each of the two subframes. In the exemplary embodiment, five bits are allocated to indicating a codebook index and another five bits are allocated to specifying a corresponding gain value. In the exemplary embodiment, the codebook used for quarter rate voiced encoding is a subset of the vectors of the codebook used for half and full rate encoding. In the exemplary embodiment, seven bits are used to specify a codebook index in the full and half rate encoding modes.

In FIG. 1, the blocks may be implemented as structural blocks to perform the designated functions or the blocks may represent functions performed in programming of a digital signal processor (DSP) or an application specific integrated circuit ASIC. The description of the functionality of the present invention would enable one of ordinary skill to implement the present invention in a DSP or an ASIC without undue experimentation.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

I claim:

1. An apparatus for selecting an encoding rate from a predetermined set of encoding rates and for encoding a frame of speech including a plurality of speech samples, comprising:

means, responsive to said speech samples and to at least one signal derived from said speech samples, for generating a set of parameters indicative of characteristics of said frame of speech; and means for receiving said set of parameters, for determining the psychoacoustic significance of said speech samples in accordance with said set of parameters, and for selecting an encoding rate from said predetermined set of encoding rates using predetermined rate selection rules.

2. An apparatus for selecting an encoding rate from a predetermined set of encoding rates and for encoding a frame of speech including a plurality of speech samples, comprising:

a mode measurement calculator that generates a set of parameters indicative of characteristics of said frame of speech in accordance with said speech samples and a signal derived from said speech samples; and a rate determination logic for receiving said set of parameters, for determining the psychoacoustic significance of said speech samples in accordance with said set of parameters, and for selecting an encoding rate from said predetermined set of encoding rates.

3. In a communication system wherein a remote station communicates with a central communication center, a subsystem for dynamically changing the transmission rate of a frame of speech transmitting from said remote station, comprising:

means, responsive to said speech frame and to a signal derived from said speech frame, for generating a set of parameters indicative of characteristics of said speech frame; and means for receiving said set of parameters, for determining the pyschoacoustic significance of said speech samples in accordance with said set of parameters, for receiving a rate command signal for generating at least one threshold value in accordance with said rate command signal, for comparing at least one parameter of said set of parameters with said at least one threshold value, and for selecting an encoding rate in accordance with said comparison.

4. In a communication system wherein a remote station communicates with a central communication center, a subsystem for dynamically changing the transmission rate of a frame of speech transmitting from said remote station, comprising:

a mode measurement calculator that generates a set of parameters indicative of characteristics of said frame of speech in accordance with said speech samples and a signal derived from said speech samples; and a rate determination logic that receives said set of parameters for determining the psychoacoustic significance of said speech samples in accordance with said set of parameters, receives a rate command signal for generating at least one threshold value in accordance with said rate command signal, compares at least one parameter of said set of parameters with said at least one threshold value, and selects an encoding rate in accordance with said comparison.

5. A method for selecting an encoding rate of a predetermined set of encoding rates for encoding a frame of speech including a plurality of speech samples, comprising:

generating a set of parameters indicative of characteristics of said frame of speech in accordance with said speech samples and with a signal derived from said speech samples; and selecting an encoding rate from said predetermined set of encoding rates in accordance with said set of parameters, said set of parameters for determining the psychoacoustic significance of said speech samples.

6. A method for adjusting the average data rate of a variable rate encoder that encodes speech frames based on how well a speech model tracks the speech frames as determined by information from a target matching signal to noise ratio (TMSNR) element communicatively coupled to the variable rate encoder, the method comprising:

increasing a threshold value for an output of the TMSNR element, wherein if the output of the TMSNR element does not exceed the increased threshold value then the average data rate of the speech frames will be increased by the variable rate encoder; and decreasing the threshold value for the output of the TMSNR element, wherein if the output of the TMSNR element exceeds the decreased threshold value then the average data rate of the speech frames will be decreased by the variable rate encoder.

7. The method of claim 6, further comprising:

estimating the number of speech frames that needs to be encoded at a full rate rather than a half rate to increase the average data rate of the speech frames.

8. The method of claim 7, wherein estimating the number of speech frames comprises using a histogram containing a plurality of differences between possible output values of the TMSNR element and a current value of the threshold value are stored, wherein the plurality of differences are used to determine how many speech frames need to be encoded at the half rate.

9. The method of claim 6, further comprising:

estimating the number of speech frames that needs to be encoded at a half rate rather than a full rate to decrease the average data rate of the speech frames.

10. The method of claim 9, wherein estimating the number of speech frames comprises using a histogram containing a plurality of differences between possible output values of the TMSNR element and a current value of the threshold value are stored, wherein the plurality of differences are used to determine how many speech frames need to be encoded at the full rate.

* * * * *